US008438951B1

(12) United States Patent
McCabe et al.

(10) Patent No.: US 8,438,951 B1
(45) Date of Patent: May 14, 2013

(54) PILL BOTTLE OPENER

(75) Inventors: Patrick A. McCabe, Crystal Beach, FL (US); Mark Jeffrey Hornick, Lutz, FL (US); Eliot Thomas Dill, Mulberry, FL (US); Michael Wood, Inverness, FL (US); Dean A. Collura, Wesley Chapel, FL (US)

(73) Assignee: University of South Florida, Tampa, FL (US)

( * ) Notice: Subject to any disclaimer, the term of this patent is extended or adjusted under 35 U.S.C. 154(b) by 300 days.

(21) Appl. No.: 12/768,009

(22) Filed: Apr. 27, 2010

Related U.S. Application Data

(60) Provisional application No. 61/173,002, filed on Apr. 27, 2009, provisional application No. 61/229,140, filed on Jul. 28, 2009.

(51) Int. Cl.
*B67B 7/18* (2006.01)
*B67B 7/44* (2006.01)

(52) U.S. Cl.
USPC ..... 81/3.32; 7/151; 81/3.4; 81/3.29; 81/3.09

(58) Field of Classification Search ..... 81/3.09, 81/3.25, 3.32, 3.36, 3.29, 3.4, 3.55, 3.56, 81/3.38, 3.33, 3.39; 7/151
See application file for complete search history.

(56) References Cited

U.S. PATENT DOCUMENTS

| | | | | |
|---|---|---|---|---|
| 3,885,478 | A | 5/1975 | Evans | |
| D286,734 | S | 11/1986 | Furman | |
| 5,621,936 | A | 4/1997 | Penaligon et al. | |
| 5,652,988 | A * | 8/1997 | Appelhoff | 7/151 |
| 5,784,933 | A * | 7/1998 | Persellin | 81/3.36 |
| 5,967,000 | A * | 10/1999 | Davis | 81/3.4 |
| 6,148,692 | A * | 11/2000 | Russell | 81/3.25 |
| 6,205,888 | B1 | 3/2001 | Laudani | |
| 6,263,761 | B1 | 7/2001 | Ryder | |
| 6,393,947 | B1 | 5/2002 | Corcoran et al. | |
| 6,651,531 | B1 | 11/2003 | Thornton | |
| 7,028,359 | B2 | 4/2006 | Mazur | |
| 8,196,221 | B2 * | 6/2012 | Fuwausa et al. | 81/3.09 |
| 2004/0111803 | A1 | 6/2004 | Mazur | |

OTHER PUBLICATIONS

Taslim et al., Capstone Design MIM 702 Technical Design Report, College of Engineering, Northeastern University, 2005, pp. 1-50.

Who's Minding Mom' Meds?, http://www.elderadv.com/documents/whoismindingmomsmeds.doc, accessed May 26, 2010.

Magnifying Medicine Cap Remover by Jakori(R), http://www.organize.com/magnifying-medi-cap-remover.html, accessed May 26, 2010.

Rx Opener, PurrFect Medicine Opener & Magnet, http://www.purrfectopener.com/purrfect-opener.html. accessed May 26, 2010.

The Medicine Mate(TM), http://www.medicinemate.com/index.html, accessed May 26, 2010.

* cited by examiner

*Primary Examiner* — Hadi Shakeri
(74) *Attorney, Agent, or Firm* — Andriy Lytvyn; Courtney M. Dunn; Smith & Hopen, P.A.

(57) ABSTRACT

A pill bottle opener including a base, a utility ring, and a cap. The utility ring includes two tabs positioned in its inner portion. The cap has a hollow, cylindrical body open on one end and has a dome-shaped top on its other end. The utility ring and cap may be interlocked by a locking mechanism.

11 Claims, 11 Drawing Sheets

PILL BOTTLE OPENER

CROSS REFERENCE TO RELATED APPLICATIONS

This application claims priority to currently pending U.S. Provisional Patent Application No. 61/173,002, filed Apr. 27, 2009, which is hereby incorporated by reference, and U.S. Provisional Patent Application No. 61/229,140, filed Jul. 28, 2009, which is hereby incorporated by reference.

FIELD OF INVENTION

This invention relates to a pill bottle opener.

BACKGROUND

According to Time Magazine, "doctors believe that osteoarthritis affects more than 20 million Americans. By 2020, that number is expected to reach 40 million." These numbers do not account for the millions of Americans who live with hand disabilities caused by strokes, accidents, or birth defects.

Almost all currently available devices available for assisting in opening medicine (pill) bottles provide a means of opening a 'turn top' bottle cap and only a few address opening the 'flip top' bottle cap. There are no known devices available to open a 'pinch top' bottle cap.

SUMMARY OF INVENTION

The novel design of the pill bottle opener of the present invention opens multiple bottle types requiring push, pinch and turn motions and can be operated with one hand. The pill bottle opener features a removable utility ring that allows the opener to adapt to a variety of medicinal packaging products. The pill bottle opener may also include a tool for removing hard to open bottle wrappers and cap seals. The tool may also be used scoop out tough to reach cotton that is typically used in packaging. The pill bottle opener may also include a magnifying glass to assist in reading small lettered labeling.

In an embodiment, the pill bottle opener includes a base, a utility ring, and a cap. The utility ring includes two tabs positioned in its inner portion. The utility ring may include additional tabs positioned in its inner portion. The cap has a hollow, cylindrical body open on one end and has a dome-shaped top on its other end. The utility ring is sized to fit at least partially within the base. The utility ring and cap may be interlocked by a locking mechanism. The locking mechanism includes a locking member on the utility ring and a complementary locking member positioned on the cap to interlock with the locking member.

In another embodiment, the complimentary locking member of the cap includes two locking pins positioned on the outer portion of the cylindrical body of the cap. The locking pins are spaced about 180 degrees apart. The locking member of the utility includes two locking grooves positioned to receive the two locking pins of the cap.

In an additional embodiment, the base may be disk-shaped. The base may also have a non-slip coating positioned thereon. There may also be a magnifying glass positioned in an aperture in the base or the cap or both.

The cylindrical body of the cap may further include a plurality of recessed ribs along its outer portion. The inner portion of the dome-shaped top of the cap may also have a non-slip coating positioned thereon.

In a further embodiment, the pill bottle opener further includes a pick. The pick may be sized to fit within the base or may be sized to fit between the cap and the utility ring. The pick may include a hook at one end with the outer portion of said hook creating a pointed end and a wedge at the opposite end.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The pill bottle opener opens a variety of bottles including pinch-tab style bottles tops, compress-and-twist style bottle tops, twist-off bottle tops, and pop-off bottle tops with alignment arrows. Preferably, the pill bottle opener has a large firm ergonomic shape and is made of non-slip material used to facilitate both gripping of the bottle top and single-handed operation. The pill bottle opener has a portable design and is made up of individual pieces which are stackable and some of which are interlocking, as shown in FIGS. 1 and 2.

Figure 1:
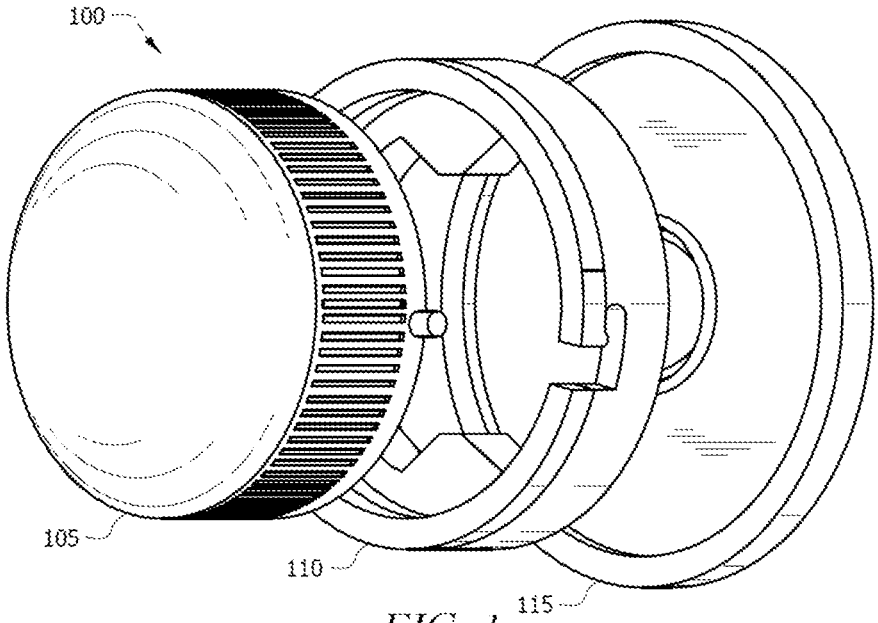
FIG. 1 is an exploded view of the pill bottle opener according to an embodiment of the present invention.
Figure 2:
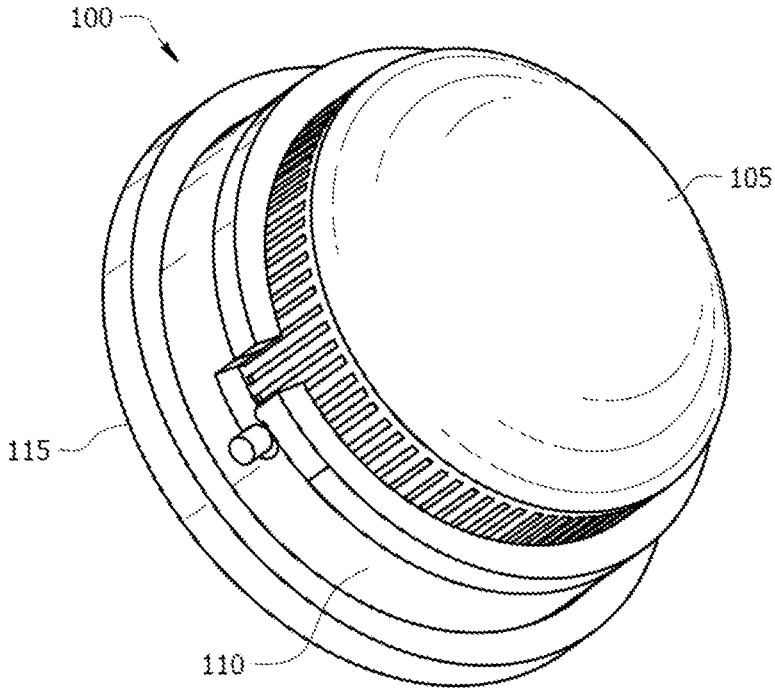
FIG. 2 is perspective view of the pill bottle opener according to an embodiment of the present invention.

As illustrated in FIGS. 1 and 2, bill bottle opener 100 includes cap 105, utility ring 110, and base 115. Utility ring 110 may vary in size to accommodate various bottle cap sizes.

Figure 3:
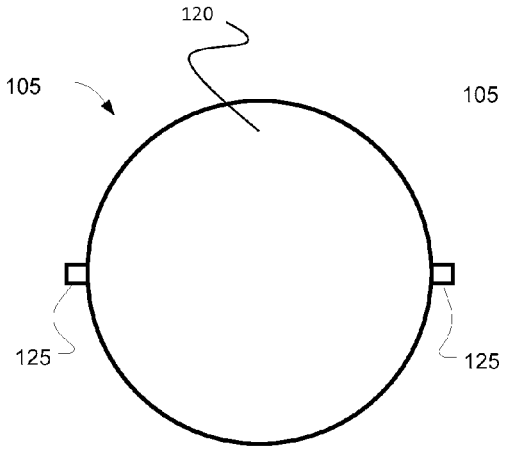
FIG. 3 is a top view of the cap of the pill bottle opener according to an embodiment of the present invention.
Figure 4:
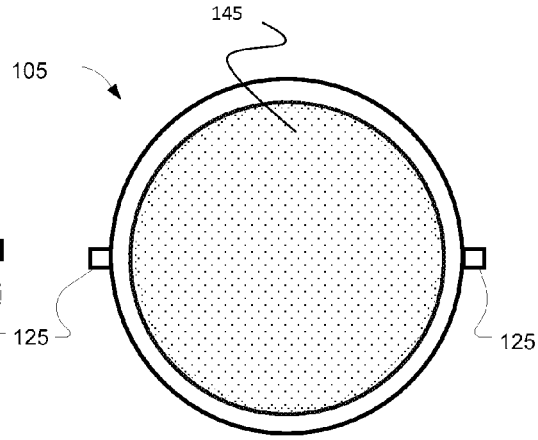
FIG. 4 is a bottom view of the cap of the pill bottle opener according to an embodiment of the present invention.

A top view of cap 105 is shown in FIG. 3. Cap 105 includes dome-shaped top 120 and locking pins 125. A bottom view of cap 105 is shown in FIG. 4. The interior portion of dome-shaped top 120 is covered with non-slip material 145 which may be used to grip bottle caps when using the pill bottle opener to twist open pill bottles.

Figure 5:
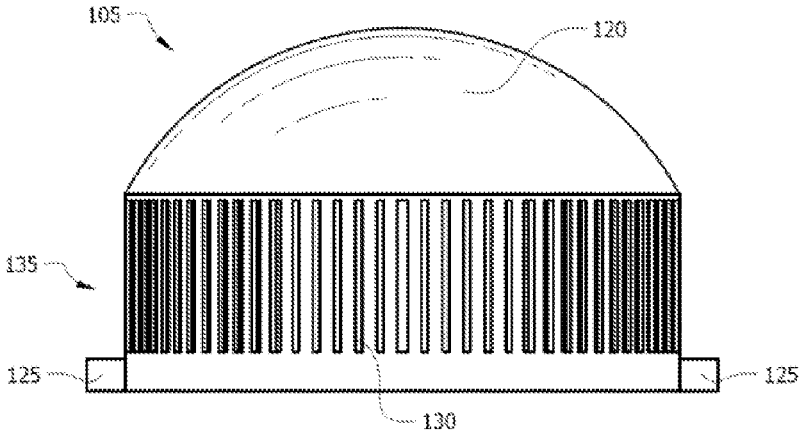
FIG. 5 is a side view of the cap of the pill bottle opener according to an embodiment of the present invention.
Figure 6:
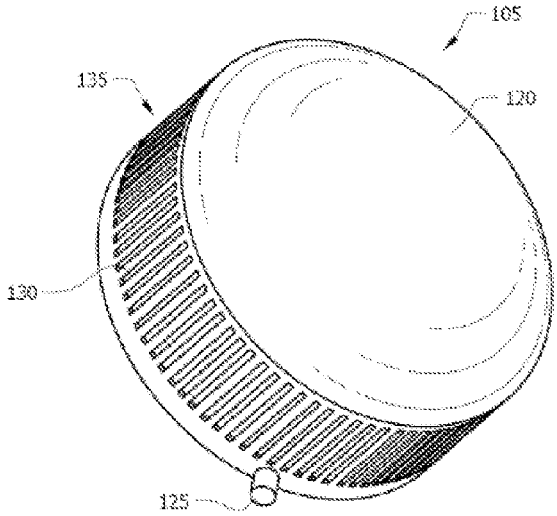
FIG. 6 is a perspective view of the cap of the pill bottle opener according to an embodiment of the present invention.

FIG. 5 is a side view of cap 105. As shown, cap 105 may also include recessed ribs 130 along outer portion of cylindrical section 135. As shown in the perspective view of FIG. 6, locking pins 125 may be cylindrical in shape and are attached to cylindrical section 135 of cap 105. Locking pins 125 are used to lock utility ring 110 to cap 105 through an interlocking mechanism. Cap 105 may optionally include a magnifying glass positioned in its dome-shaped top.

Figure 7:
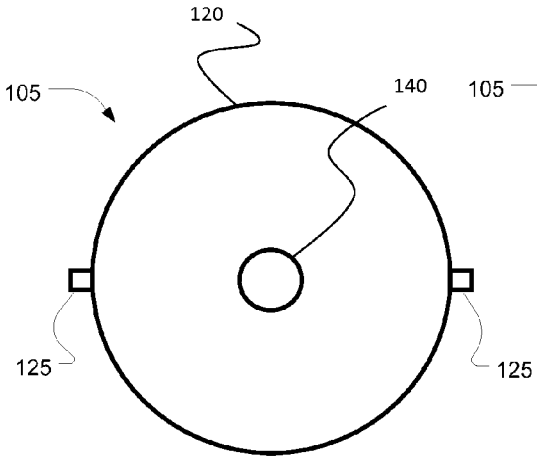
FIG. 7 is a top view of the cap of the pill bottle opener having a magnifying glas according to an embodiment of the present invention.
Figure 8:
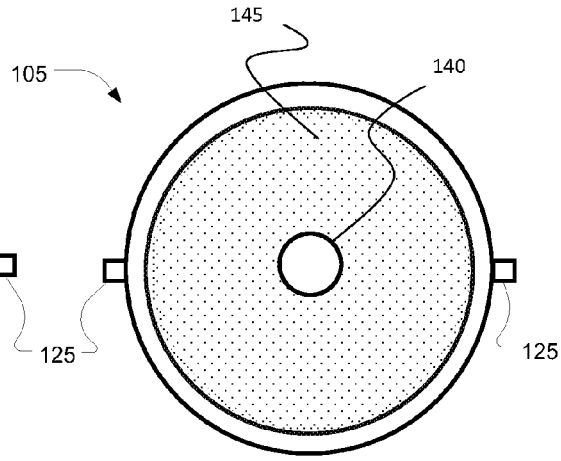
FIG. 8 is a bottom view of the cap of the pill bottle opener and a pill bottle having a magnifying glass according to an embodiment of the present invention.
Figure 9:
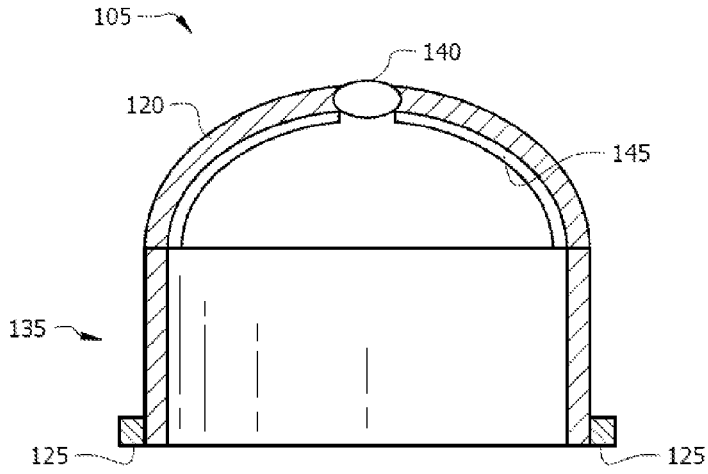
FIG. 9 is a side view of the cap of the pill bottle opener and a pill bottle having a magnifying glass according to an embodiment of the present invention.

Cap 105 may optionally include a magnifying glass 140 positioned in dome-shaped top, as shown in the top view of cap 105 in FIG. 7 and the bottom view of cap 105 in FIG. 8. FIG. 9 also illustrates magnifying glass 140 in a side view of cap 105.

Figure 10:
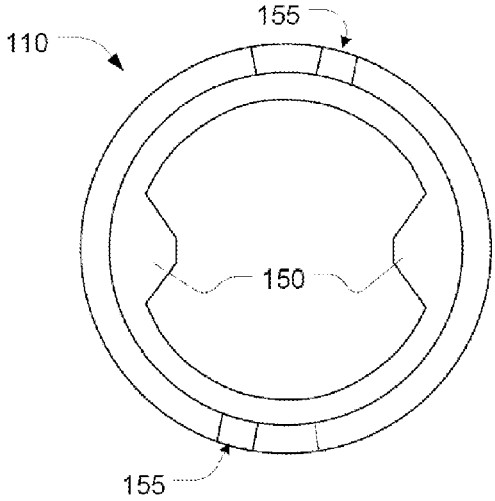
FIG. 10 is a top view of the utility ring of the pill bottle opener according to an embodiment of the present invention.
Figure 11:
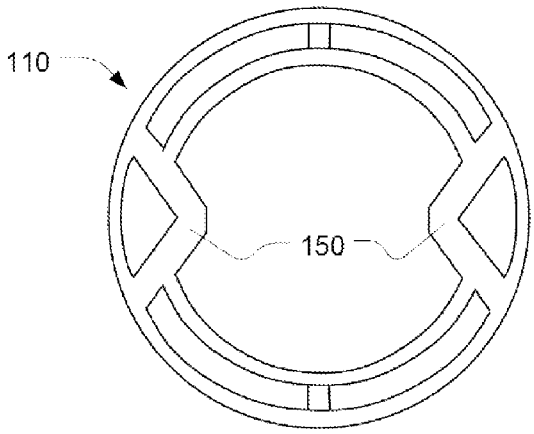
FIG. 11 is a bottom view of the utility ring of the pill bottle opener according to an embodiment of the present invention.

Utility ring 110 is shown in FIGS. 10-13. Utility ring 110 is used to facilitate the opening of pinch-tab style pill bottle caps, without requiring the user to manually pinch the tabs. Utility ring 110 can be made in various sizes to support different pinch-tab bottle sizes. A top view of utility ring 110 is shown in FIG. 10, and a bottom view thereof is shown in FIG. 11. Utility ring 110 includes protruding tabs 150. Protruding tabs 150 compress the pinch-tabs of the pinch-tab style bottle caps.

For ordinary twist-off caps and push-down twist-off caps, additional tabs may also be included on the interior of utility ring 110 to add structural stability, so as to help prevent utility ring 110 from easily slipping off a pill bottle while the cap is being twisted off. The additional tabs may also help hold the pill bottle in the center of utility ring 110 without slipping off tabs 150.

Figure 12:
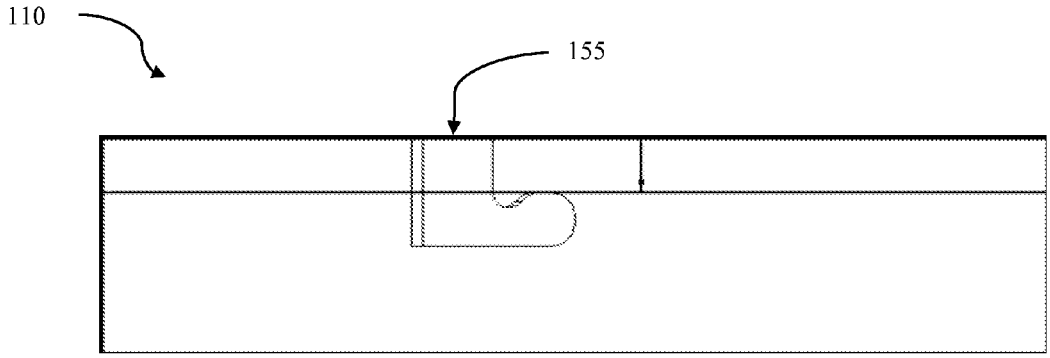
FIG. 12 is a side view of the utility ring of the pill bottle opener having a first interlocking mechanism according to an embodiment of the present invention.

Utility ring 110 may also includes locking grooves 155 along its outer edge. Locking pins 125 on cap 105 lock into locking grooves 155 so that utility ring 110 will not fall off during use. Locking grooves 155 and locking pins 125 of cap 105 are together herein referred to as the interlocking mechanism. A side view and a perspective view of utility ring 110, better illustrating locking grooves 155, are shown in FIG. 12-13.

Figure 14:
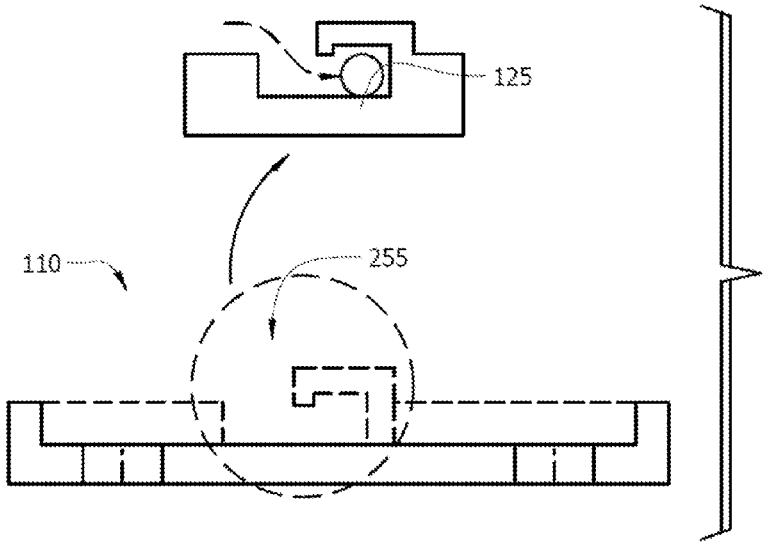
FIG. 14 is a side view of the utility ring of the pill bottle opener having a second interlocking mechanism according to an embodiment of the present invention.
Figure 15:
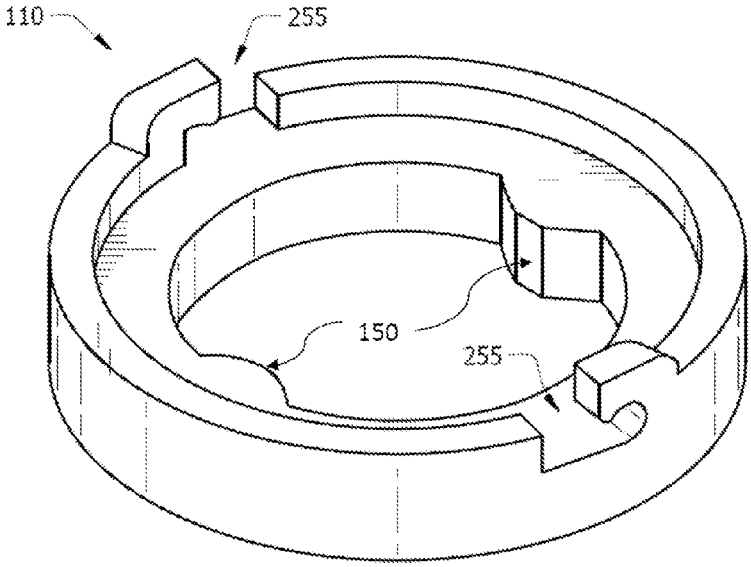
FIG. 15 is a perspective view of the utility ring of the pill bottle opener having a second interlocking mechanism according to an embodiment of the present invention.

Another embodiment of the locking mechanism is illustrated in FIGS. 14 and 15. In this embodiment locking groove 255 is established by a protruding L-shaped member. FIG. 14 also illustrates placement of locking pin 125 of cap 105 into locking groove 255.

Figure 13:
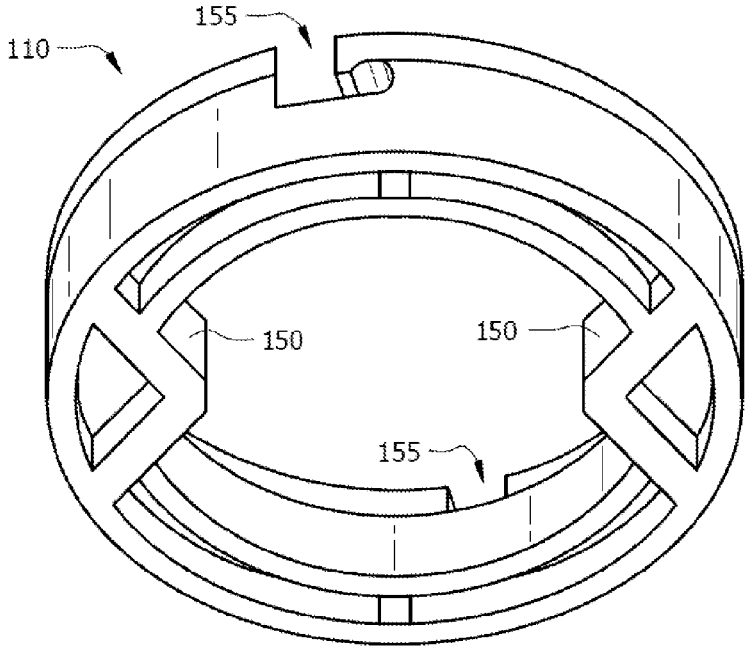
FIG. 13 is a perpective view of the utility ring of the pill bottle opener having a first interlocking mechanism according to an embodiment of the present invention.

The cut-outs in the bottom side of utility ring 110, shown in FIGS. 11 and 13 are optional and their function is to reduce the volume of material required to produce the ring, while maintaining structural stability.

Figure 16:
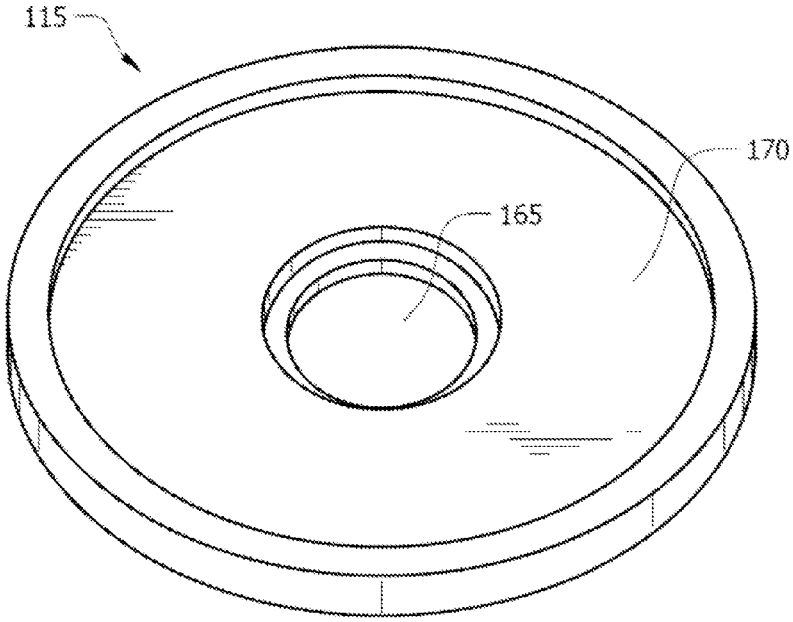
FIG. 16 is a perspective view of the top of the base of the pill bottle opener having a magnifying glass according to an embodiment of the present invention.
Figure 17:
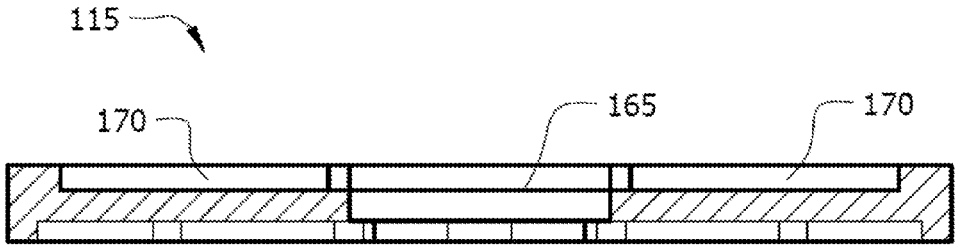
FIG. 17 is a side view of the base of the pill bottle opener having a magnifying glass according to an embodiment of the present invention.
Figure 18:
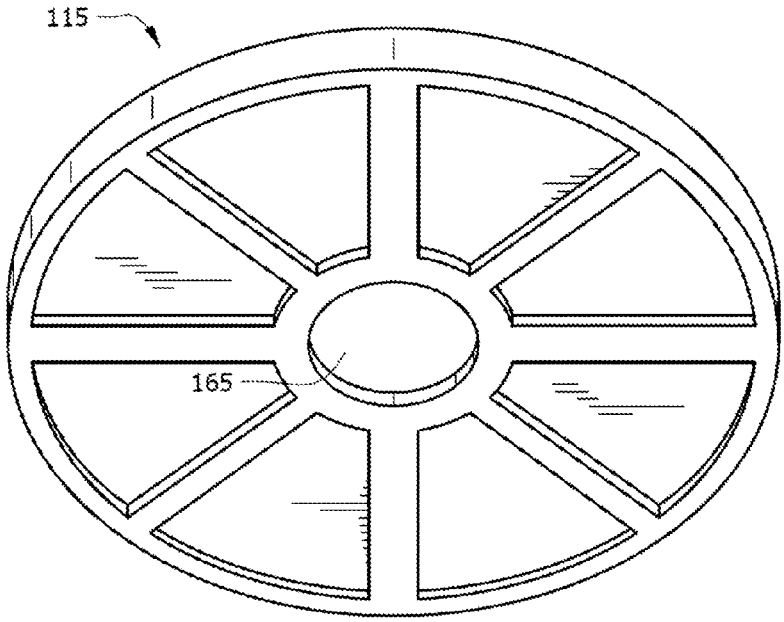
FIG. 18 is a perpective view of the bottom of the base of the pill bottle opener without a magnifying glass according to an embodiment of the present invention.
Figure 19:
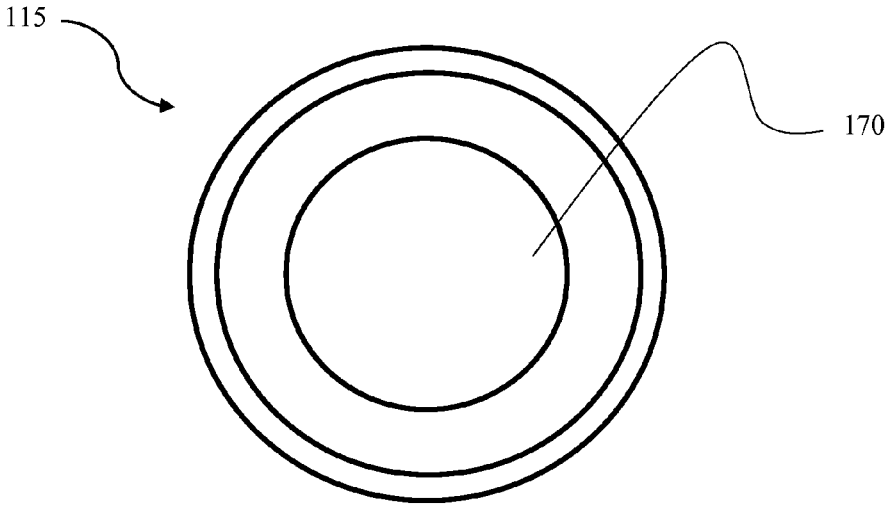
FIG. 19 is a top view view of the base of the pill bottle opener without a magnifying glass according to an embodiment of the present invention.
Figure 20:
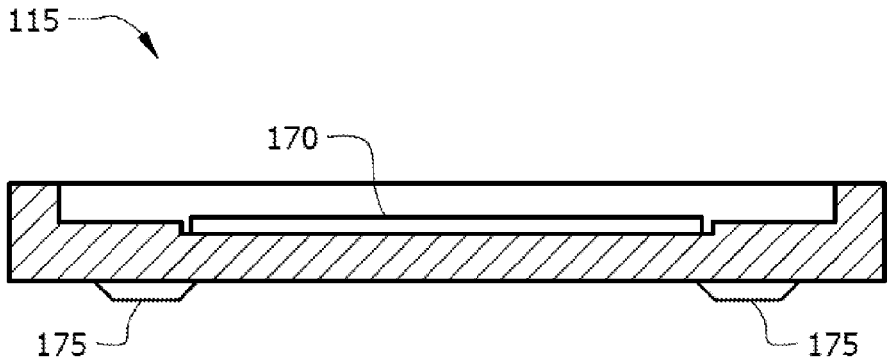
FIG. 20 is a side view of the base of the pill bottle opener without a magnifying glass according to an embodiment of the present invention.
Figure 21:
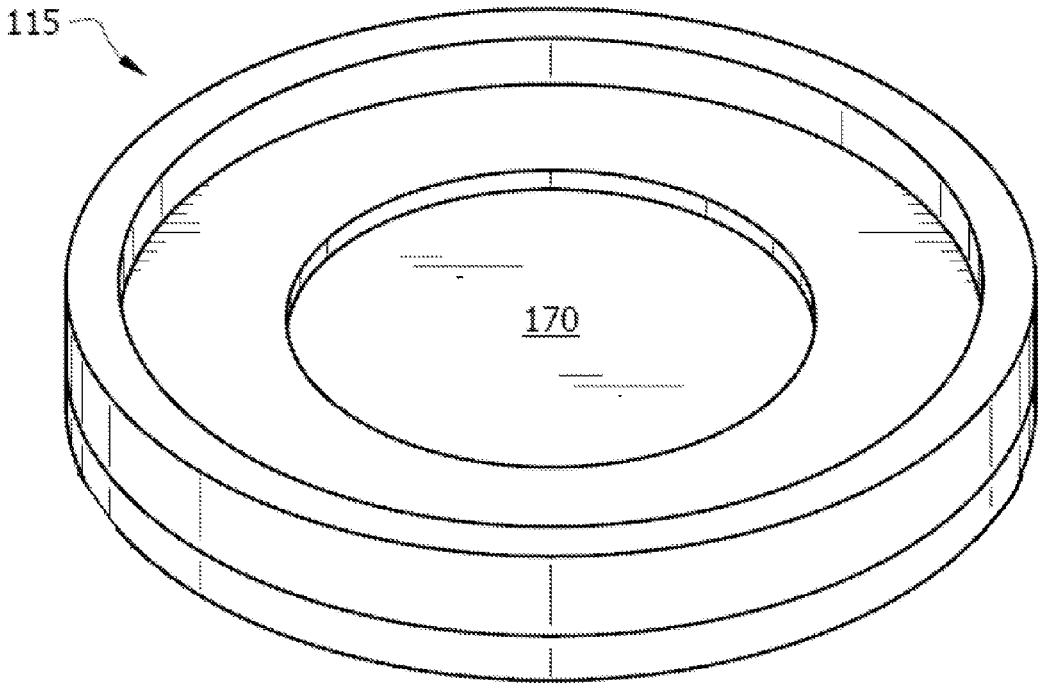
FIG. 21 is a perspective view of the base of the pill bottle opener without a magnifying glass according to an embodiment of the present invention.

Base 115 is illustrated in FIGS. 16-21. FIGS. 16-18 show base 115 having magnifying glass 165 at its center and FIGS. 19-21 shows base 115 without the magnifying glass. Base may have rubber feet 175. Rubber feet 175 may prevent slipping when the base is used on a potentially slippery surface, such as a table top or counter top. Base may also contain non-slip surface 170 on its top side to help reduce movement of a bottle placed on base 115.

The cut-outs in the bottom surface of base 115, shown in FIG. 18, are optional and may be used to reduce the amount of material required to produce the ring.

Figure 22:
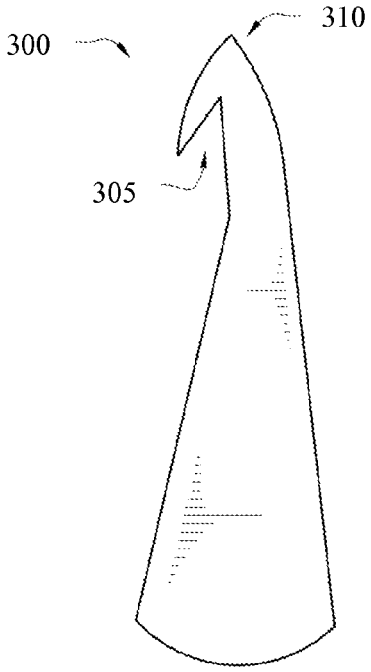
FIG. 22 is a side view of the pick of the pill bottle opener according to an embodiment of the present invention.
Figure 23:
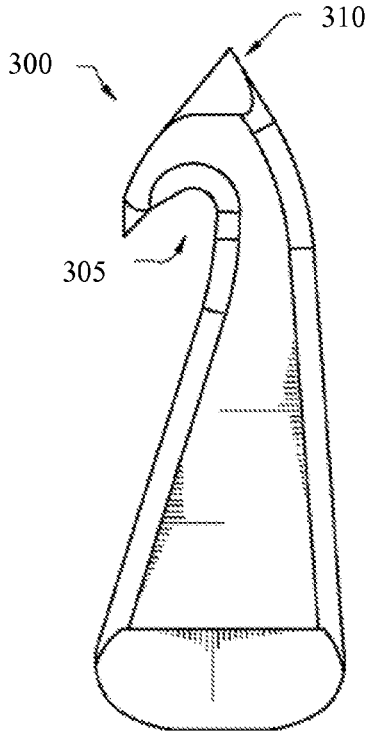
FIG. 23 is a perspective view of the pick of the pill bottle opener according to an embodiment of the present invention.
Figure 24:
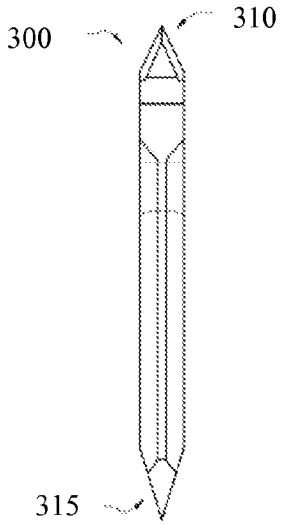
FIG. 24 is a back view of the the pick of the pill bottle opener according to an embodiment of the present invention.

As shown in FIGS. 22-24, pick 300 includes hook 305, pointed end 310, and flat (or wedge) end 315. The pick may be used to pierce protective foil on the bottle opening, to remove cotton from the bottles, and to assist in removing pop-off bottle tops. The pick is sized to fit inside the base or between utility ring 110 and cap 105 without falling out.

Figure 25:
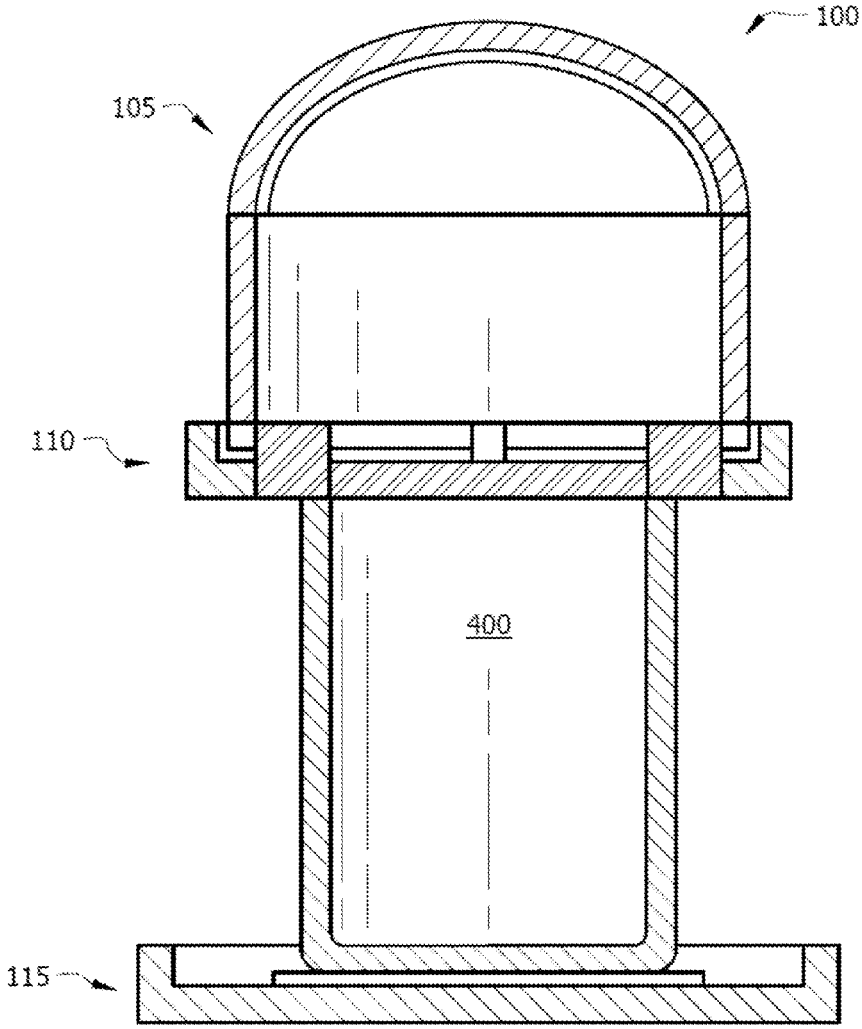
FIG. 25 is a side view of the pill bottle opener and a pill bottle according to an embodiment of the present invention.

FIG. 25 illustrates the placement of pinch-top bottle 400 in pill bottle opener 100.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A bottle opener, comprising:

a base;

a utility ring having two protruding tabs positioned in its inner portion and a locking member, said protruding tabs being adapted to compress pinch-tabs on a pinch-tab cap, said utility ring being sized to fit at least partially within said base;

a cap separate from said utility ring having a hollow, cylindrical body open on a first end and having a dome-shaped closed top on a second end and having a complementary locking member positioned to interlock with said locking member of said utility ring;

wherein said complimentary locking member of said cap comprises two locking pins positioned on an outer portion of said cylindrical body; and wherein said locking member of said utility ring comprises two locking grooves positioned to receive said two locking pins of said cap.

2. The bottle opener of claim 1, wherein said base is disk-shaped.

3. The bottle opener of claim 1, further comprising:

a non-slip coating positioned on said base.

4. The bottle opener of claim 1, further comprising:

a magnifying glass positioned in an aperture located in said base.

5. The bottle opener of claim 1, further comprising:

a plurality of recessed ribs along an outer portion of said cylindrical body.

6. The bottle opener of claim 1, further comprising:

a magnifying glass positioned in an aperture located in said dome-shaped top of said cap.

7. The bottle opener of claim 1, further comprising:

a non-slip coating positioned on the inner portion of said dome-shaped top of said cap.

8. The bottle opener of claim 1, further comprising:

a pick sized to fit within said base.

9. The bottle opener of claim 1, wherein said two locking pins are about 180 degrees apart.

10. The bottle opener of claim 1, wherein said utility ring further comprises at least a third protruding tab positioned in its inner portion.

11. A bottle opener, comprising:

a base;

a utility ring having two protruding tabs positioned in its inner portion and a locking member, said protruding tabs being adapted to simultaneously compress pinch-tabs on a pinch-tab cap, said utility ring being sized to fit at least partially within said base;

a cap having a hollow, cylindrical body open on a first end and having a dome-shaped top on a second end and having a complementary locking member positioned to interlock with said locking member of said utility ring; and a pick sized to fit within said base, wherein said pick comprises a hook at a first end, the outer portion of said hook creating a pointed end, and a wedge at a second end.

* * * * *